US006343386B1

(12) United States Patent
Chou

(10) Patent No.: US 6,343,386 B1
(45) Date of Patent: Feb. 5, 2002

(54) PADDING MEMBER FOR A PAIR OF SWIMMING GOGGLES

(76) Inventor: Terry Chou, No. 12, Hsin Ho Herng Road, Tainan City (TW)

( * ) Notice: Subject to any disclaimer, the term of this patent is extended or adjusted under 35 U.S.C. 154(b) by 0 days.

(21) Appl. No.: 09/828,971

(22) Filed: Apr. 10, 2001

(51) Int. Cl.[7] ..... A61F 9/02

(52) U.S. Cl. ..... 2/428; 2/440; 2/441; 2/445; 2/427; 2/426

(58) Field of Search ..... 2/428, 430, 440, 2/426

(56) References Cited

U.S. PATENT DOCUMENTS 3,725,953 A * 4/1973 Johnson et al. ..... 2/14 W
5,890,237 A * 4/1999 Chiang ..... 2/440
5,894,606 A * 4/1999 Chiang ..... 2/440
5,896,588 A * 4/1999 Chiang ..... 2/428
5,950,248 A * 9/1999 Kawashima et al. ..... 2/441
6,052,834 A * 4/2000 Chou ..... 2/428

* cited by examiner

*Primary Examiner*—John J. Calvert
*Assistant Examiner*—James G Smith
(74) *Attorney, Agent, or Firm*—Rosenberg, Klein & Lee

(57) ABSTRACT

A padding member is made from soft material and comprises a main ring portion, a connecting portion extending from an outer side of the main ring portion for engaging with a main frame of a pair of swimming goggles, and an annular contact flange extending from an inner side of the main ring portion for intimate contact with a wearer's eye socket. The connecting portion includes an engaging piece extending radially inward from an inner periphery thereof, the engaging piece including an engaging edge. An engaging portion extends radially inward from the annular contact flange, thereby defining a cushioning space between the engaging piece and the engaging portion. The engaging edge of the engaging piece and the engaging portion are bonded together to seal the cushioning space.

2 Claims, 8 Drawing Sheets

PADDING MEMBER FOR A PAIR OF SWIMMING GOGGLES

BACKGROUND OF THE INVENTION

1. Field of the Invention

The present invention relates to a padding member for a pair of swimming goggles that provides improved wearing comfort by means of providing uniform load distribution to the wearer's eye socket.

2. Description of the Related Art

FIGS. 7 and 8 of the drawings illustrate a pair of conventional swimming goggles comprising two lenses 1', a bridge 3', two padding members 2', and a head strap 4'. Each lens 1' is made from rigid transparent material and includes a first connecting portion 11' on an inner end thereof for engaging with the bridge 3' and a second connecting portion 12' on an outer end thereof for engaging with the head strap 4'. Each lens 1' further includes an annular flange 13' on an inner side thereof for engaging with an associated padding member 2'.

Each padding member 2' is a ring-like member made from soft material and includes a resilient main ring portion 22', a connecting portion 21' extending from a side of the main ring portion 22' for engaging with the annular flange 13' of the associated lens 1', and an annular contact portion 23' extending from the other side of the main ring portion 22' to provide intimate contact with a wearer's eye socket. Thus, the resilient main ring portion 22' keeps the annular contact portion 23' in intimate contact with the wearer's eye socket.

However, as illustrated in FIG. 9, although the annular contact portion 23' is still in intimate contact with the wearer's eye socket when the head strap 4' is pulled, the main ring portion 22' is not deformed uniformly due to the contour of the eye socket. As a result, the wearing comfort is lost, since a portion "b" of the annular contact portion 23' will press against the connecting portion 21 ' and a rigid corner "c" of the associated lens 3'.

FIG. 10 illustrates a further conventional padding member 5', wherein the padding member 5' is in the form of a hollow endless ring with a certain air pressure to provide a cushioning effect to the wearer's eye socket. However, as illustrated in FIG. 11, when the head strap 7' is pulled rearward, the force is not uniformly distributed to the padding member 5'. In addition, the padding member 5' has a uniform cross section that does not correspond to the contour of the wearer's eye socket, the outer side "e" of the padding member 5' will be subjected to a larger pulling force and thus become more flat when it is squeezed by the wearer's eye socket. The outer edge of the rigid lens 6' presses against the wearer's eye socket and thus causes discomfort. In addition, the relatively outwardly protruding portion of the wearer's eye socket will press against the padding member 5' and thus be in contact with the rigid lens 6'. A solution to these drawbacks is to fill high-pressure gas into the padding member 5' to thereby prevent the outer side "e" from becoming flat when it is pressed against by the wearer's eye socket, yet the padding member 5' per se becomes too hard for the wearer's eye socket. Furthermore, as illustrated in FIG. 11, water accumulates in an area "f" which adversely affects the intimate contact between the padding member 5' and the wearer's eye socket.

FIG. 12 illustrates another conventional padding member 8' comprising a main ring portion 83', a connecting portion 81' extending from a side of the main ring portion 83' for engaging with an annular flange (not labeled) of a lens 9', and an annular contact portion 82' extending from the other side of the main ring portion 83' to provide intimate contact with a wearer's eye socket. The main ring portion 83' includes a sealed annular space 831' into which gas or fluid is filled. Thus, in use, the annular contact portion 82' is kept in intimate contact with the wearer's eye socket under the action of the sealed annular space 831' that provides increased resilience to the padding member 8'. It was, however, found that the wearer feels uncomfortable, as the main ring portion 83' with such a sealed annular space 831 ' is too hard for the wearer's eye socket.

SUMMARY OF THE INVENTION

It is the primary object of the present invention to provide an improved padding member for a pair of swimming goggles to provide wearing comfort by means of providing uniform load distribution to the wearer's eye socket.

The present invention provides a padding member made from soft material and comprises a main ring portion, a connecting portion extending from an outer side of the main ring portion for engaging with a main frame of a pair of swimming goggles, and an annular contact flange extending from an inner side of the main ring portion for intimate contact with a wearer's eye socket. The connecting portion includes an engaging piece extending radially inward from an inner periphery thereof, the engaging piece including an engaging edge. An engaging portion extends radially inward from the annular contact flange, thereby defining a cushioning space between the engaging piece and the engaging portion. The engaging edge of the engaging piece and the engaging portion are bonded together to seal the cushioning space.

A reinforcing piece is mounted in the cushioning space in an area that is subjected to a relatively larger force from the wearer's eye socket.

The annular contact flange and the sealed cushioning space of the padding member are designed according to the contour of the wearer's eye socket to provide a uniform load distribution to the wearer's eye socket, thereby providing intimate contact and improved wearing comfort. The reinforcing piece avoids deformation in the area of the cushioning space that is generally subjected to a relatively larger force from the wearer's eye socket. The wearing comfort is further improved.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
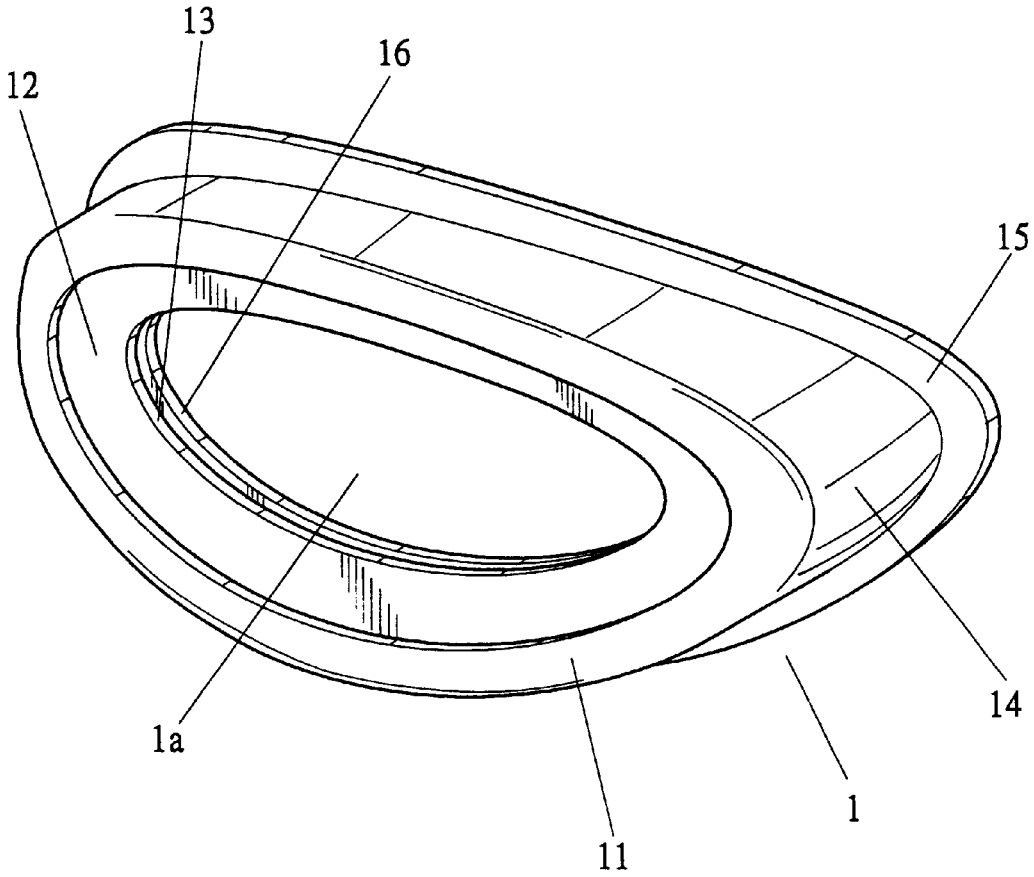
FIG. 1 is a perspective view of a semi-product of a padding member in accordance with the present invention.
Figure 2:
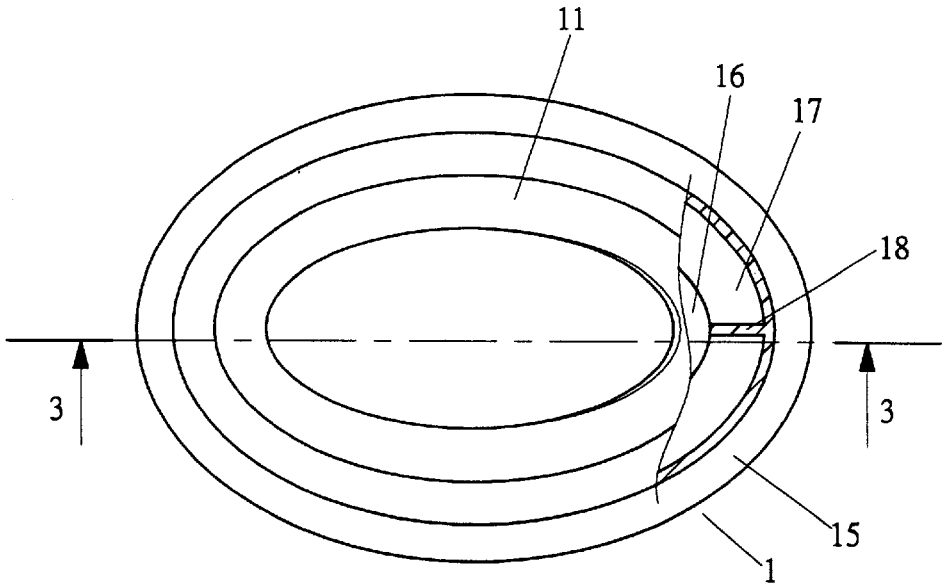
FIG. 2 is a front elevational view, partly sectioned, of the padding member in FIG. 1.
Figure 3:
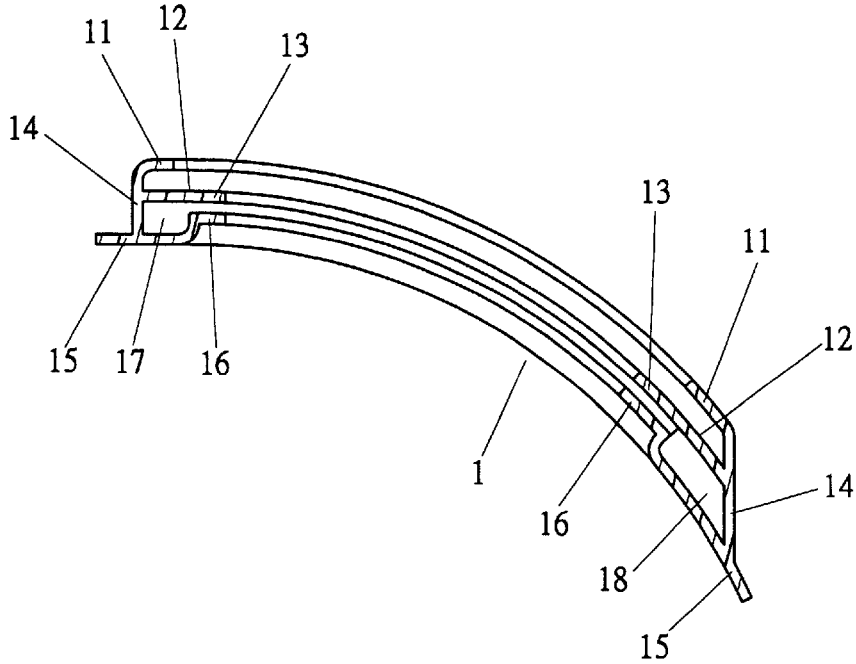
FIG. 3 is a sectional view taken along line 3—3 in FIG. 2.
Figure 4:
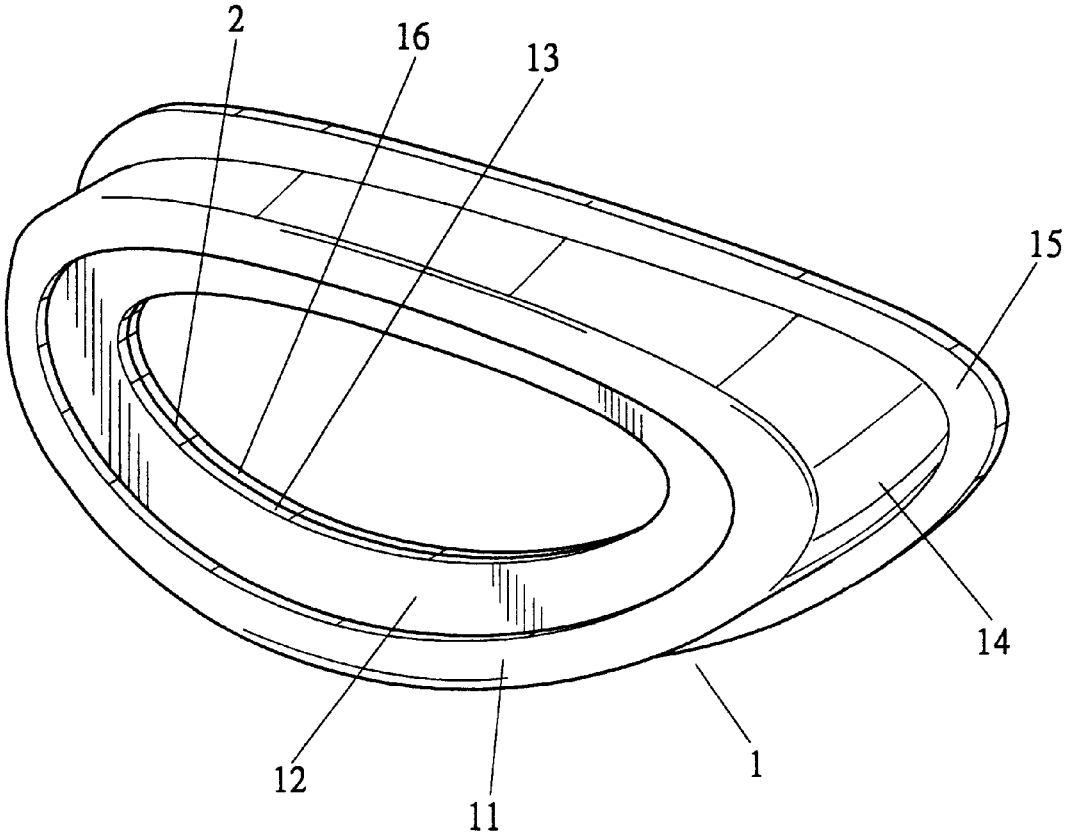
FIG. 4 is a perspective view of the padding member in accordance with the present invention.

FIGS. 1 through 3 illustrate a semi-product of a padding member 1 in accordance with the present invention and FIG. 4 generally includes a fin al product of the padding member 1 in accordance with the present invention. As illustrated in FIGS. 1 and 3, the semi-product of the padding member 1 is made from soft material (such as silicon rubber) and integrally formed. The padding member semi-product 1 includes a main ring portion 14, a connecting portion 11 extending from an outer side of the main ring portion 14, and an annular contact flange 15 extending from an inner side of the main ring portion 14.

The connecting portion 11 includes an engaging piece 12 extending radially inward from an inner periphery thereof, best shown in FIGS. 1 and 3. The engaging piece 12 includes an engaging edge 13. The annular contact flange 15 may be irregular in shape and configured corresponding to the contour of a wearer's eye socket. As illustrated in FIG. 3, an engaging portion 16 extends radially inward from the annular contact flange 15, thereby defining a cushioning space 17 between the engaging piece 12 and the engaging portion 16. A reinforcing piece 18 may be mounted in the cushioning space 17 in an area that is generally subjected to a relatively larger force from the wearer's eye socket.

Figure 5:
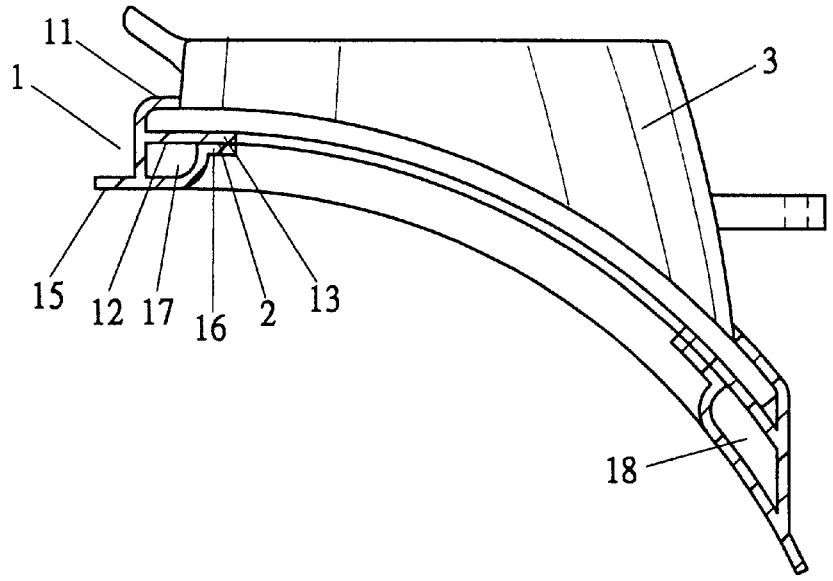
FIG. 5 is a sectional view illustrating the padding member in accordance with the present invention and a portion of a main frame of a pair of swimming goggles.

Referring to FIGS. 4 and 5, a bonding agent 2 or other suitable means is used to bond the engaging edge 13 of the engaging piece 12 and the engaging portion 16 extending from the annular contact flange 15, thereby sealing the cushioning space 17. Thus, the air inside the cushioning space 17 is isolated from the environment to provide a cushioning effect. In addition, the cushioning space 17 is configured irregularly corresponding to the contour of the wearer's contour and thus provides a uniform load distribution to the wearer's eye socket. It is noted that the connecting portion 11 is engaged with a corresponding portion of a main frame 3 of a pair of swimming goggles.

Figure 6:
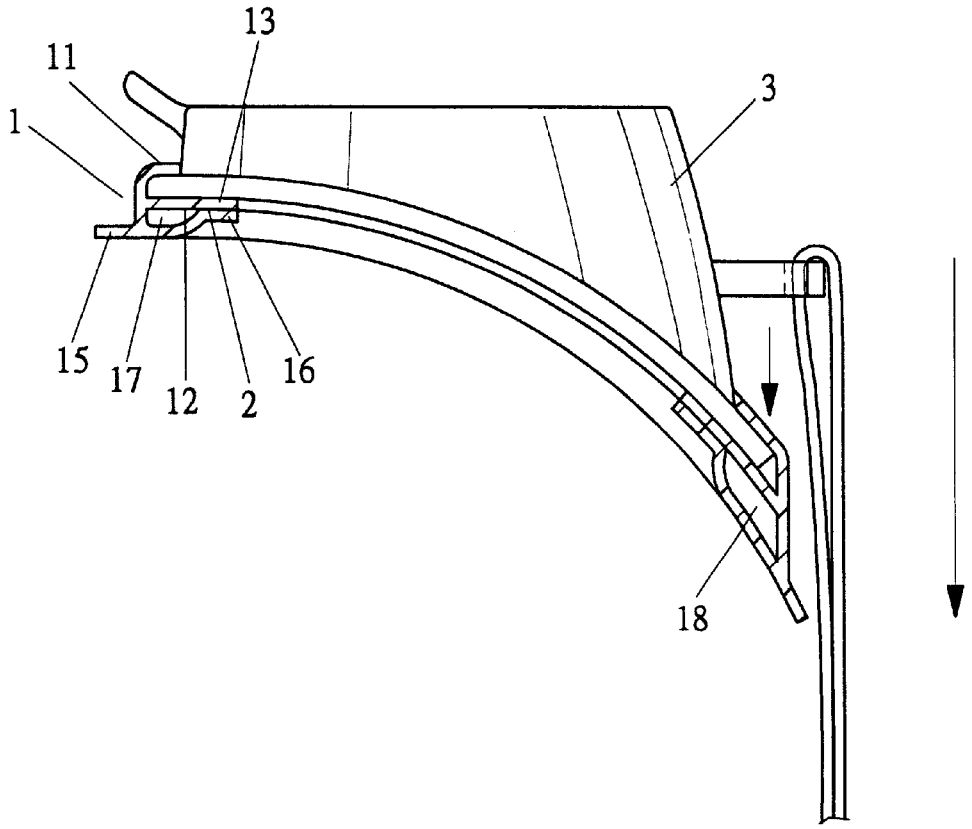
FIG. 6 is a sectional view similar to FIG. 5, illustrating use of the padding member.
Figure 7:
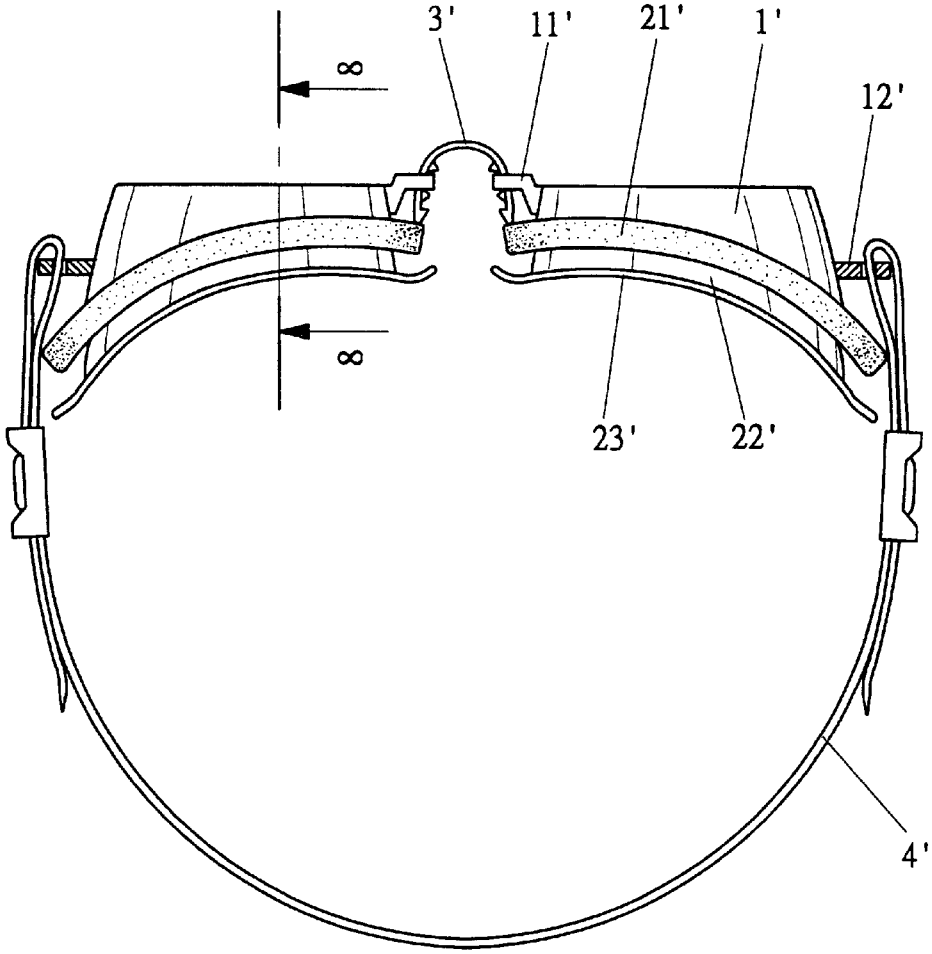
FIG. 7 is a top view of a pair of conventional swimming goggles.
Figure 8:
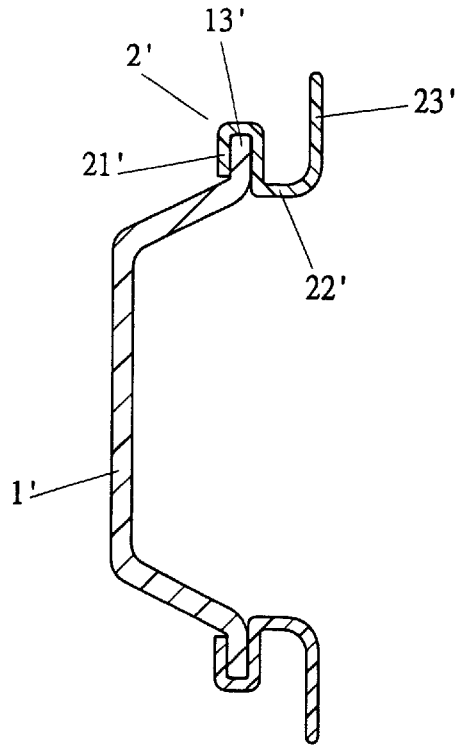
FIG. 8 is a sectional view taken along line 8—8 in FIG. 7.
Figure 9:
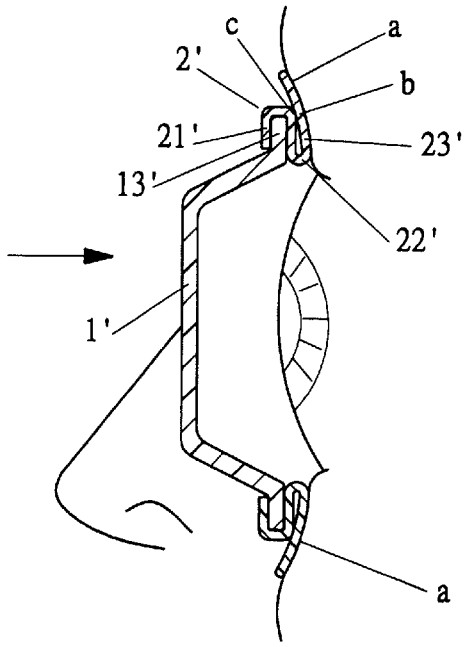
FIG. 9 is a sectional view similar to FIG. 8, illustrating use of the padding member.
Figure 10:
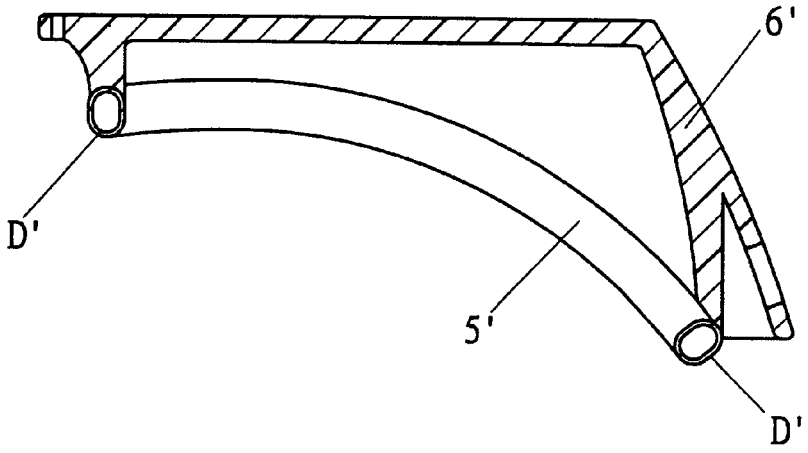
FIG. 10 is a sectional view of a portion of another pair of conventional swimming goggles.
Figure 11:
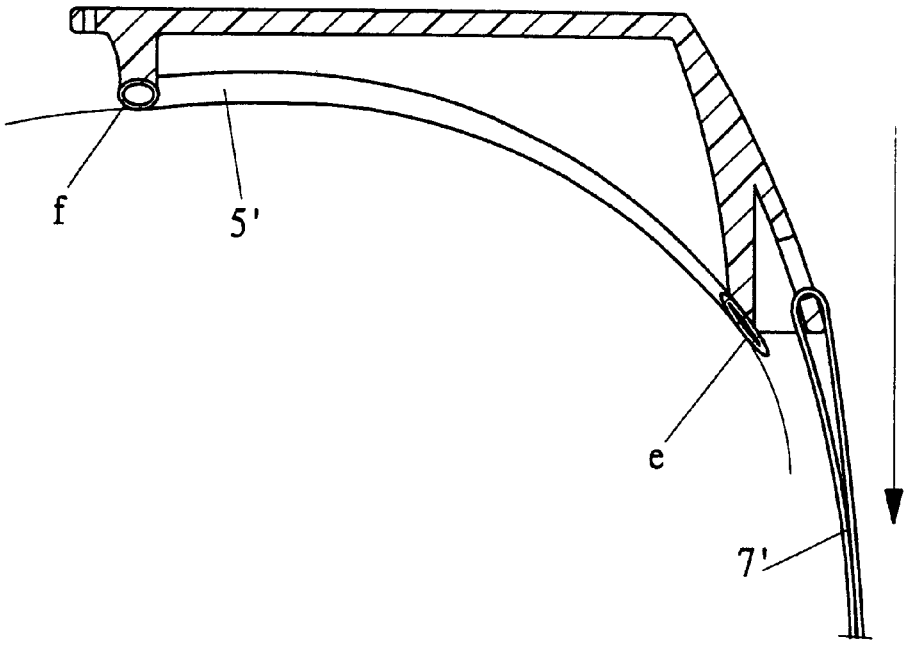
FIG. 11 is a sectional view similar to FIG. 10, illustrating use of the padding member.
Figure 12:
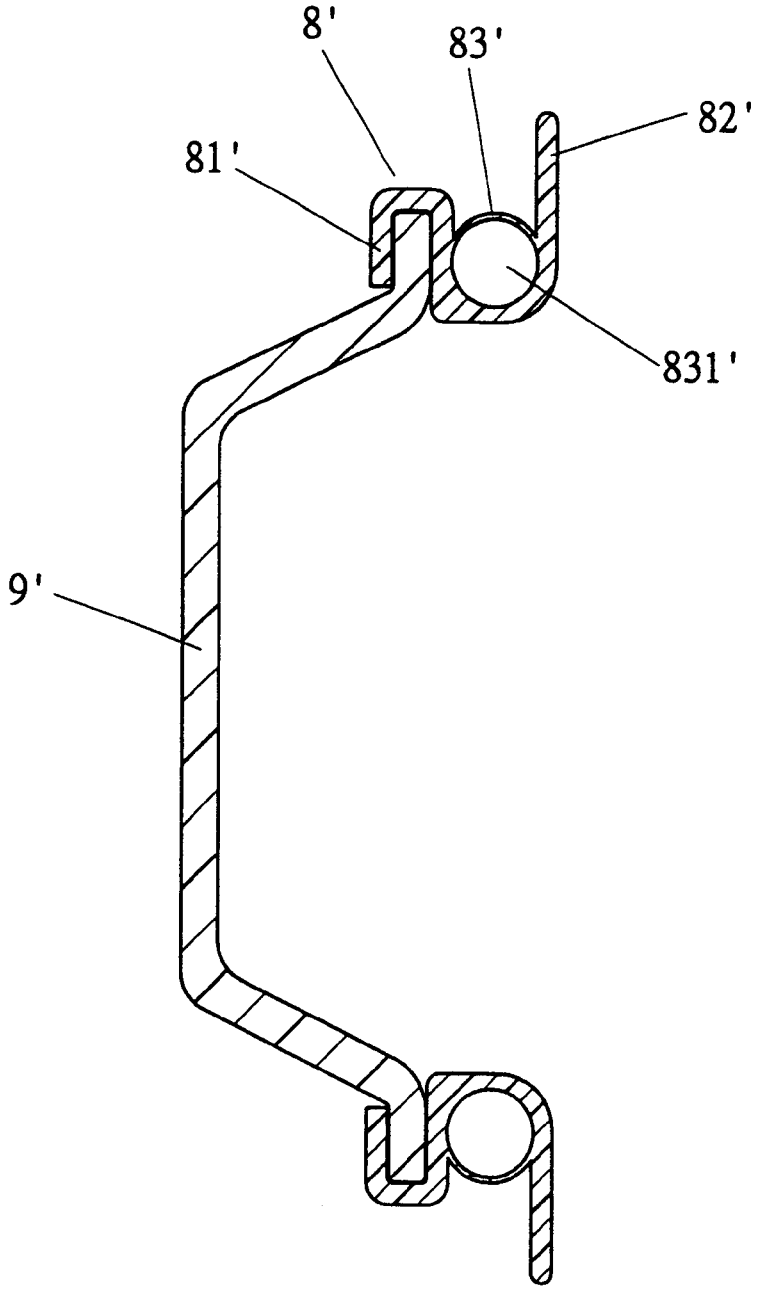
FIG. 12 is a sectional view illustrating a lens and a further conventional padding member.

Referring to FIG. 6, in use, the annular contact flange 15 of the padding member 1 is in intimate contact with the wearer's eye socket, and the sealed cushioning space 17 provides an extra cushioning effect. In addition, the reinforcing piece 18 provides an improved pressure-resisting ability in the corresponding area of the cushioning space 17 which is generally subjected to a relatively larger force from the wearer's eye socket. Thus, the wearer's eye socket is prevented from pressing against rigid portions of the main frame 3 of the pair of swimming goggles. An improved wearing comfort is thus provided.

In accordance with the present invention, it is appreciated that the annular contact flange 15 and the sealed cushioning space 17 of the padding member 1 are designed according to the contour of the wearer's eye socket to provide a uniform load distribution to the wearer's eye socket, thereby providing intimate contact and improved wearing comfort. The reinforcing piece 18 avoids deformation in the area of the cushioning space 17 that is generally subjected to a relatively larger force from the wearer's eye socket. The wearing comfort is further improved.

Although the invention has been explained in relation to its preferred embodiment, it is to be understood that many other possible modifications and variations can be made without departing from the scope of the invention as hereinafter claimed.

What is claimed is:

1. A padding member for a pair of swimming goggles having a main frame, the padding member being made from soft material and comprising:

a main ring portion having an inner side and an outer side;

a connecting portion extending from the outer side of the main ring portion, the connecting portion being adapted to engage with a main frame of a pair of swimming goggles and including an engaging piece extending radially inward from an inner periphery thereof, the engaging piece including an engaging edge; and an annular contact flange extending from the inner side of the main ring portion for intimate contact with a wearer's eye socket, an engaging portion extending radially inward from the annular contact flange, thereby defining a cushioning space between the engaging piece and the engaging portion, the engaging edge of the engaging piece and the engaging portion being bonded together to seal the cushioning space.

2. The padding member as claimed in claim 1, further comprising a reinforcing piece mounted in the cushioning space in an area that is subjected to a relatively larger force from the wearer's eye socket.

* * * * *